US005090229A

United States Patent [19]

Hahn et al.

[11] Patent Number: 5,090,229

[45] Date of Patent: Feb. 25, 1992

[54] APPARATUS FOR SUPPORTING A WORKPIECE

[75] Inventors: Roger A. Hahn, Arvada; Ray L. Bowles; Robert H. Schultz, both of Golden; Warren R. Williams, Collins; Michael E. Bagrosky, Arvada, all of Colo.

[73] Assignee: Coors Brewing Company, Golden, Colo.

[21] Appl. No.: 624,351

[22] Filed: Dec. 7, 1990

[51] Int. Cl.[5] ..... B21D 22/20

[52] U.S. Cl. ..... 72/347

[58] Field of Search ..... 72/96, 115, 117, 273, 72/283, 347, 349

[56] References Cited

U.S. PATENT DOCUMENTS

| | | | |
|---|---|---|---|
| 1,985,833 | 12/1934 | Lampart | 72/347 |
| 3,312,097 | 4/1967 | Hendrickson et al. | 72/347 |
| 3,889,509 | 6/1975 | Miller et al. . | |

*Primary Examiner*—Lowell A. Larson
*Attorney, Agent, or Firm*—Klaas & Law

[57] ABSTRACT

The invention is directed to the punch on the reciprocating ram of a can body making machine wherein the punch is mounted on one end portion of the reciprocating ram so that the punch is capable of rotational movement relative to the reciprocating ram.

19 Claims, 1 Drawing Sheet

APPARATUS FOR SUPPORTING A WORKPIECE

FIELD OF THE INVENTION

This invention relates generally to a workpiece support for moving the workpiece through a processing operation and more particularly to the punch on the end of the reciprocating ram of a can body making machine.

BACKGROUND OF THE INVENTION

In the formation of containers, such as can bodies formed from aluminum, it is conventional to use a redraw assembly, a plurality of ironing die assemblies, a domer assembly and a stripping assembly. In such a process, a punch is mounted on a reciprocating ram which moves into the redraw assembly and has a cup or can blank positioned thereon and then moves through the ironing die assemblies to have the cup formed into a can body. The punch moves the cup and the formed can body completely through the ironing die assemblies so that the formed can body may be domed and then stripped from the punch during the return stroke of the ram. The length of the stroke of the ram during this operation is fairly long and the punch is exposed to large forces as it moves through the plurality of ironing die assemblies. Since the can body has been removed from the punch, the outside diameter of the punch on the return stroke is now smaller than the inside diameter of the forming die assembly and because of the cantilever mounting of the ram, there is a tendency for some portion of the punch to strike a portion of one of the ironing die assemblies on the return stroke. This tendency is increased during the continuous operation of the can body making machine. When the punch is secured on the ram, there is a tendency to bulge the punch slightly at the center which in some instances is about 0.0004 of the diameter of the punch. During the operation of the can body making machine, the temperature of the punch rises and increases the bulge. The result is wear on the punch which results in improperly formed sidewalls of the can bodies which causes problems in stripping the can bodies from the punch and in weakening the strength of the sidewalls so that the can body making operation has to be stopped to replace the punch.

BRIEF DESCRIPTION OF THE INVENTION

This invention provides a workpiece support means that is mounted on one end portion of a reciprocating ram so that the workpiece support means can rotate relative to the one end portion of the ram. Also, the mounting includes resilient means which permit the expansion of the workpiece support means without bulging.

In a preferred embodiment of the invention, the workpiece support means comprises a punch for a can body making machine which is mounted for rotation on one end portion of the reciprocating ram. The one end portion has a first generally outer surface and a second generally cylindrical outer surface which has a diameter greater than the diameter of the first generally cylindrical outer surface to form an abutment shoulder thereon. The workpiece support means has a first generally cylindrical inner surface having a diameter slightly larger than the diameter of the first generally cylindrical outer surface so that the workpiece support means may be moved over the first generally cylindrical outer surface. The workpiece support means has a generally radially extending end surface for contacting the abutment shoulder. The mounting means for mounting the workpiece support means on the one end portion of the reciprocating ram comprise an internally threaded opening in the one end portion. An externally threaded bolt is threaded into the internally threaded opening and has an annular member projecting radially therefrom. The workpiece support means has a second generally cylindrical inner surface having a diameter greater than the diameter of the first generally cylindrical inner surface to form an abutment shoulder thereon. The annular member has a first generally cylindrical outer surface and a second generally cylindrical outer surface having a diameter less than the diameter of the first generally cylindrical outer surface to form an annular recess therein. Resilient means, such as a Belleville washer, are located in the recess and are in contact with the annular member and the abutment shoulder of the workpiece support means to urge the workpiece support means against the abutment shoulder of the one end portion. The externally threaded bolt has a tool engageable portion so that it can be rotated by a tool to put sufficient force on the workpiece support means to stop the workpiece support means from moving axially during the reciprocation of the ram but to permit it to rotate relative to the ram when a rotational force is applied thereto. The resilient means also permit expansion of the workpiece support means caused by a rise in the temperature of the support. Locking means are provided to hold the externally threaded bolt in the adjusted position and comprise an internal opening extending through the externally threaded bolt. At least one axially and radially extending slot extends from the internal opening through at least a portion of the threaded portion of the externally threaded bolt. Force applying means are provided to apply a radially outwardly directed force on the slot portion to force the externally threaded bolt against the internally threaded opening of the one end portion to prevent relative rotation between the one end portion and the externally threaded bolt.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
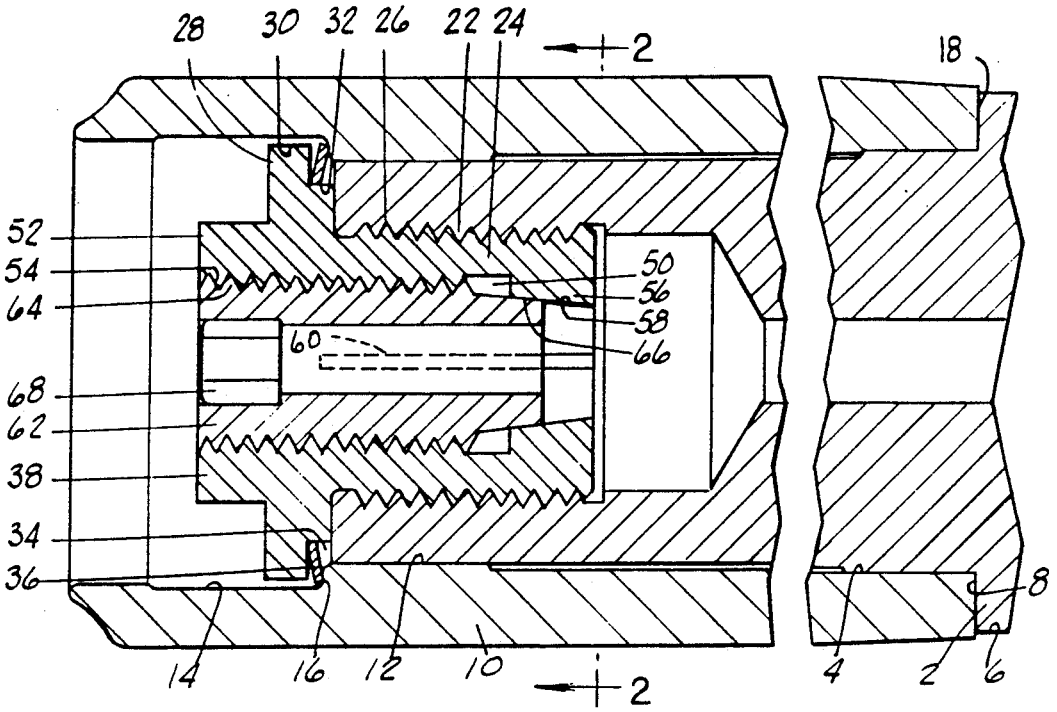
FIG. 1 is a cross-sectional view of the apparatus of this invention.
Figure 2:
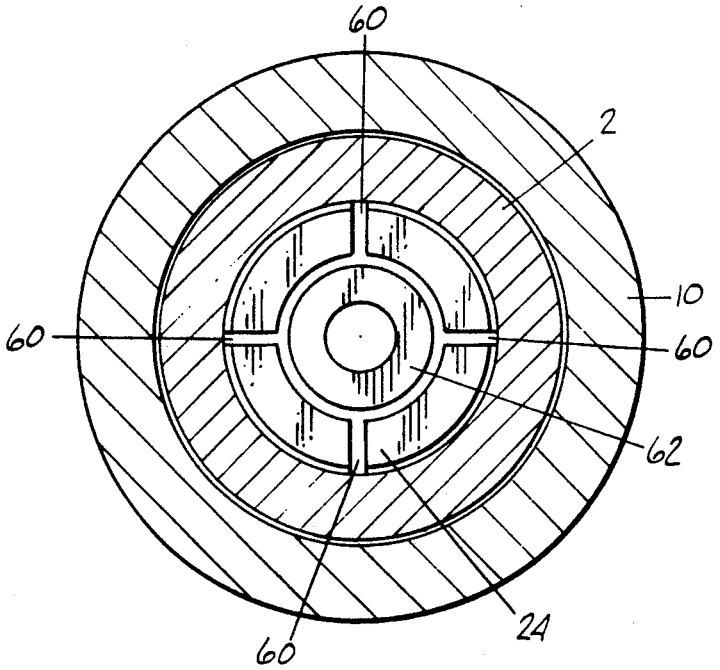
FIG. 2 is a cross-sectional view taken on the line 2—2 of FIG. 1.

In the drawing, there is illustrated a portion of a can body making machine such as that in U.S. Pat. No. 4,934,167 issued June 19, 1990, which is incorporated herein by reference thereto. One end portion 2 of the reciprocating ram (not shown) has a first generally cylindrical outer surface 4 and a second generally cylindrical outer surface 6 having a diameter greater than the first generally cylindrical outer surface 4 to form an abutment shoulder 8 therebetween.

Workpiece support means 10 are provided and have a first generally cylindrical inner surface 12 and a second generally cylindrical inner surface 14 having a diameter greater than the first generally cylindrical inner surface 12 to form an abutment shoulder 16 therebetween. The first generally cylindrical inner surface 12 has a diameter slightly greater than the diameter of the first generally cylindrical outer surface 4 so that the workpiece support means 10 may be moved over the first generally cylindrical outer surface 4 until a radially extending end surface 18 thereof contacts the abutment shoulder 8.

Holding means are provided for holding the workpiece support means 10 on the one end portion 2 and comprise an internally threaded opening 22 in the one end portion 2. A bolt 24 is provided and has an externally threaded portion 26 in threaded engagement with the internally threaded opening 22. The bolt 24 has an annular member 28 projecting radially outwardly and has a first generally cylindrical outer surface 30 and a second generally cylindrical outer surface 32 having a diameter less than the diameter of the first generally cylindrical outer surface 30 to form an annular recess 34. Resilient means 36, such as a Belleville washer, are located in the recess 34 so that, when the bolt 24 is tightened, the resilient means 36 bear against the annular member 28 and the abutment shoulder 16 to urge the radially extending end surface 18 against the abutment shoulder 8 to prevent axial movement of the workpiece support means 10 but to permit rotation of the workpiece support means 10 relative to the one end portion 2. The bolt 24 is provided with a head portion 38 having a configuration, such as a hex head, so that a tool may be used therewith to tighten to bolt 24. The bolt is tightened to an amount, such as a torque between about 25 and 50 lbs. at a distance of 1 foot and preferably about 40 lbs at a distance of 1 foot, which is sufficient to prevent axial movement of the support member but to allow for the rotation of the support member relative to the ram. Any expansion of the support member due to temperature is taken up by the Bellevile washer.

Locking means are provided for locking the bolt 24 in its torqued position and comprise an internal opening 50 passing through the bolt 24. The opening 50 has a first portion 52 having internal threads 54 and a second portion 56 having an inner generally conical surface 58. The bolt 24 has four axially and radially extending slots 60 extending from the internal opening 50 through the entire portion of the externally threaded portion 26 so that the externally threaded portion 26 may be moved radially outwardly when a sufficient force is applied thereto. A force applying bolt 62 has an externally threaded portion 64 for mating threaded engagement with the internal threads 54 and an outer generally conical surface 66 for rotating and sliding engagement with the inner generally conical surface 58. The force applying bolt 62 has a head portion 68 having a configuration, such as an allen socket, to receive a tool, such as an allen wrench, so that the force applying bolt 62 can be rotated. Rotation of the force applying bolt 62 causes the outer generally conical surface 66 to move over the inner generally conical surface 58 to apply a radially outwardly directed force on the portions of the bolt 24 between the slots 60 to press the external threads 26 against the internal threads 22 to prevent movement of the bolt 24 relative to the one end portion 2.

As stated above, the invention is particularly directed to a can body making machine wherein the workpiece, a cup or can blank to be formed into a can body, is supported on the workpiece support member, a punch, and moved through the can forming operation. On the return stroke of the punch, after the formed can body has been stripped, there is a tendency for the punch to contact one portion of a forming die. This invention allows the punch to be rotated by the contact between the punch and the forming die to change the wear characteristics of the punch. In one can body forming operation for making a particular type of can body, the punch will be rotated about 180 degrees after the formation of about 11,000 can bodies.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for supporting a workpiece on a reciprocating ram for movement through a work performing operation comprising:

a ram mounted for reciprocation;

support means on one end portion of said reciprocating ram for supporting said workpiece;

holding means for holding said support means on said one end portion of said ram and for permitting relative rotational and preventing axial movement between said support means and said one end portion of said ram;

said one end portion having a first generally cylindrical outer surface and a second generally cylindrical outer surface having a diameter greater than the diameter of said first generally cylindrical outer surface to form an abutment shoulder therebetween;

said support means having a first generally cylindrical inner surface having a diameter slightly larger than said diameter of said first generally cylindrical outer surface so that said support means may be moved over said first generally cylindrical outer surface;

said support means having a generally radially extending end surface for contacting said abutment shoulder; and said holding means including resilient means urging said end surface in contacting relationship with said abutment shoulder.

2. The invention as in claim 1 wherein:

said support means rotate on said one end portion.

3. The invention as in claim 1 wherein:

said support means comprise the punch on a can body making apparatus.

4. Apparatus for supporting a workpiece on a reciprocating ram for movement through a work performing operation comprising:

a ram mounted for reciprocation;

support means rotatably mounted on one end portion of said reciprocating ram for supporting said workpiece;

holding means for holding said support means on said one end portion of said ram and for permitting relative rotational movement between said support means and said one end portion of said ram;

said one end portion having a first generally cylindrical outer surface and a second generally cylindrical outer surface having a diameter greater than the diameter of said first generally cylindrical outer surface to form an abutment shoulder therebetween;

said support means having a first generally cylindrical inner surface having a diameter slightly larger than said diameter of said first generally cylindrical outer surface so that said support means may be moved over said first generally cylindrical outer surface;

said support means having a generally radially extending end surface for contacting said abutment shoulder;

wherein said holding means comprising:

an internally threaded opening extending into said one end portion;

an externally threaded bolt threaded into said internally threaded opening;

an annular member projecting radially outwardly from said externally threaded bolt;

said support means having a second generally cylindrical inner surface having a diameter greater than the diameter of the first generally cylindrical inner surface to form an abutment shoulder therebetween; and resilient means between said annular member and said abutment shoulder of said support means for resiliently urging said support means against said abutment shoulder of said one end portion.

5. The invention as in claim 4 wherein:

said resilient means having sufficient strength to prevent axial movement of said support member.

6. The invention as in claim 4 wherein:

said resilient means comprise a Belleville washer.

7. The invention as in claim 4 and further comprising:

locking means for preventing relative rotation between said one end portion and said externally threaded bolt.

8. The invention as in claim 7 wherein said locking means comprise an internal opening in said externally threaded bolt;

at least one axially and radially extending slot extending from said internal opening through at least a portion of the externally threaded portion of said externally threaded bolt; and force applying means for applying a radially outwardly directed force on at least a portion of said internal opening to force at least a portion of said externally threaded portion of said externally threaded bolt against said internally threaded opening of said one end portion.

9. The invention as in claim 8 wherein said force applying means comprise:

said internal opening having a first portion having internal threads and a second portion having an internal generally conical surface;

a force applying bolt having a first portion having external threads and a second portion having an external generally conical surface; and said force applying bolt being threaded into said first portion of said internal opening so that rotation of said force applying bolt moves said external generally conical surface against said internal generally conical surface to apply said radially outwardly directed force thereon.

10. The invention as in claim 9 wherein:

said at least one axially and radially extending slot extends through the entire portion of said externally threaded portion of s id externally threaded bolt.

11. The invention as in claim 9 wherein:

said at least one axially and radially extending slot comprises a plurality of axially and radially extending slots.

12. The invention as in claim 11 wherein:

said support means rotate on said one end portion.

13. The invention as in claim 4 wherein said annular member comprises:

a first generally cylindrical outer surface and a second generally cylindrical outer surface having a diameter less than the diameter of said first generally cylindrical outer surface to form an annular recess; and said resilient means located in said recess.

14. The invention as in claim 13 wherein:

said resilient means having sufficient strength to prevent axial movement of said support member.

15. The invention as in claim 4 and further comprising:

locking means for preventing relative rotation between said one end portion and said externally threaded bolt.

16. The invention as in claim 15 wherein said locking means comprise an internal opening in said externally threaded bolt;

at least one axially and radially extending slot extending from said internal opening through at least a portion of the externally threaded portion of said externally threaded bolt; and force applying means for applying a radially outwardly directed force on at least a portion of said internal opening to force at least a portion of said externally threaded portion of said externally threaded bolt against said internally threaded opening of said one end portion.

17. The invention as in claim 16 wherein said force applying means comprise:

said internal opening having a first portion having internal threads and a second portion having an internal generally conical surface;

said internal opening having a first portion having internal threads and a second portion having an internal generally conical surface;

a force applying bolt having a first portion having external threads and a second portion having an external generally conical surface; and said force applying bolt being threaded into said first portion of said internal opening so that rotation of said force applying bolt moves said external generally conical surface against said internal generally conical surface to apply said radially outwardly directed force thereon.

18. The invention as in claim 17 wherein:

said at least one axially and radially extending slot extends through the entire portion of said externally threaded portion of said externally threaded bolt.

19. The invention as in claim 17 wherein:

said at least one axially and radially extending slot comprises a plurality of axially and radially extending slots.

* * * * *